US007581707B2

(12) United States Patent
Saraf

(10) Patent No.: US 7,581,707 B2
(45) Date of Patent: Sep. 1, 2009

(54) AUTOMATIC UNIVERSAL MULTI-PURPOSE GROUND STAND

(76) Inventor: James Saraf, 19 Dundee Cir., Harwich, MA (US) 02645

( * ) Notice: Subject to any disclaimer, the term of this patent is extended or adjusted under 35 U.S.C. 154(b) by 114 days.

(21) Appl. No.: 10/642,538

(22) Filed: Aug. 18, 2003

(65) Prior Publication Data

US 2005/0040297 A1 Feb. 24, 2005

(51) Int. Cl.
*F16M 13/00* (2006.01)

(52) U.S. Cl. ..... 248/530; 248/156; 52/165; 405/259.1; 408/124; 172/25; 135/118

(58) Field of Classification Search ..... 248/530, 248/156, 545, 680; 52/165; 405/259.1, 252.1; 408/124; 172/25, 41; 135/118, 157, 156; 173/217; 310/47, 50
See application file for complete search history.

(56) References Cited

U.S. PATENT DOCUMENTS

| | | | | | |
|---|---|---|---|---|---|
| 1,203,138 | A | * | 10/1916 | Schuler | 310/80 |
| 2,063,052 | A | * | 12/1936 | Robins | 52/157 |
| 2,569,528 | A | * | 10/1951 | Kandle | 403/300 |
| 2,628,797 | A | * | 2/1953 | Campomar | 248/545 |
| 2,759,486 | A | * | 8/1956 | Pesaturo | 135/16 |
| 2,975,848 | A | * | 3/1961 | Roberts | 173/216 |
| 3,012,441 | A | * | 12/1961 | Lamb et al. | 74/16 |
| 3,318,058 | A | * | 5/1967 | Sullivan | 52/157 |
| 3,832,861 | A | * | 9/1974 | Jahnke et al. | 52/127.5 |
| 3,961,671 | A | * | 6/1976 | Adams et al. | 173/1 |
| 4,091,882 | A | * | 5/1978 | Hashimoto | 175/286 |
| 4,240,771 | A | * | 12/1980 | Derbyshire | 408/124 |
| 4,320,886 | A | * | 3/1982 | Stodola | 248/523 |
| 4,635,502 | A | * | 1/1987 | George | 74/625 |
| 4,637,283 | A | * | 1/1987 | Bertram et al. | 81/3.2 |
| 5,156,369 | A | * | 10/1992 | Tizzoni | 248/545 |
| 5,396,916 | A | * | 3/1995 | Boissonnault | 135/16 |
| 6,032,880 | A | * | 3/2000 | Verrills et al. | 248/156 |
| D456,131 | S | * | 4/2002 | Dotson, Jr. | D3/10 |
| 2003/0029276 | A1 | * | 2/2003 | Falcone | 81/3.2 |

* cited by examiner

*Primary Examiner*—Kimberly T Wood
(74) *Attorney, Agent, or Firm*—Cambridge Lawyers Group, LLC; Kenneth Onyema

(57) ABSTRACT

An automatic, universal, multi-purpose ground stand to securely affix an umbrella, or any like device, into any malleable surface such as sand, grass, gravel or dirt. The device is intended to accommodate any size or shape of commercially available beach or sun umbrellas. This device also contemplates the securement of other devices such as fishing poles. The device is comprised, primarily, of a main tube with a helical auger screw bit and a DC electric motor to turn the screw. A user of said device would extend the helical auger screw bit, engage the DC electric motor, and allow the action of the DC electric motor to secure the helical auger screw into a malleable surface.

10 Claims, 6 Drawing Sheets

AUTOMATIC UNIVERSAL MULTI-PURPOSE GROUND STAND

BACKGROUND OF INVENTION

This invention relates to a universal, automatic, multi-purpose ground stand. The inventor first intended this stand to be used with any beach umbrella. Any person who has tried to place an umbrella in the sand at a beach on a windy day knows that it is quite difficult to firmly secure the umbrella stand so that the umbrella does not, almost immediately tip over. While there are many stands available on the market today none of these devices automatically screw the stand into the ground, nor are the stands available today able to accommodate any type of umbrella or other device such as a fishing pole. Thus, it would be highly desirable, and especially for those people with limited strength, to have a solution that addresses the need to securely and firmly screw a multi-purpose stand into the ground.

Various stands exist in prior art. Stands intended primarily for umbrella securement are generally not motorized. Additionally, many of the umbrella stands taught in prior art use a weight system, rather than anchor screws to secure the stand to the ground. Stands intended primarily for use with fishing poles are not motorized, and generally are of a tripod or fulcrum nature. Examples of prior art are discussed as follows.

U.S. Pat. No. 5,906,077 issued to Andiarena teaches an anchoring device particularly for umbrellas. In this patent the anchor screw is not on continuous thread, but rather a series of threads. Nowhere in his patent does Andiarena discuss the use of a DC motor to provide the power needed to secure the stand in the ground.

U.S. Pat. No. 6,446,930 issued to Li discloses an umbrella base. The outer surface of the stand is formed on an exterior shell that is fabricated out of a corrosion-resistant material. A weighted mass is attached to an inner surface of the exterior shell.

U.S. Pat. No. 6,354,554 issued to Hollenbeck teaches a beach umbrella support stand. Hollenbeck, in his patent, uses a large planar surface to hold the umbrella in place. He does not teach the use of a anchor screw, nor does he use a DC motor.

U.S. Pat. No. 5,207,406 issued to Stine, et al, discloses an umbrella stand. This design teaches an umbrella stand designed to be used principally in conjunction with a beach umbrella with the stand to be located on sand. The umbrella shaft is to be optionally mounted either in a vertical position or inclined position on the stand. The stand is to include a container to which is to added a quantity of a weighty substance, such as sand, to provide a heavy enough base to prevent the umbrella from tipping over during usage.

U.S. Pat. No. 6,443,172 issued to Brumfield teaches a beach umbrella with self-supporting stand. A beach umbrella is supported with a stand having a lower shaft and an upper shaft, with the upper shaft supporting a beach umbrella mast. Before attaching the umbrella mast, the tubular upper shaft serves as an impact tool against a protuberance on the lower shaft, allowing hammering of the lower shaft into the ground.

U.S. Pat. No. 6,412,748 issued to Girard discloses a ground anchoring mechanism. This ground anchoring mechanism is used to attach an article such as a beach umbrella to the mechanism. It comprises an anchor post with a lower pointed end and a horizontal step section extending sideways from the anchor post such that the anchor post may be driven into the ground by using a person's foot on the horizontal step section and driving the anchor post in the ground using the person's weight.

U.S. Pat. No. 5,535,978 issued to Rodriquez, et al, teaches a beach umbrella anchoring apparatus. This anchoring apparatus works by brushing aside a small area of dry sand to expose the damp sand beneath. The lower end of the tube is inserted into the damp sand, preferably by twisting the tube as it is inserted, extracting a plug of the moist sand that is driven up into the tube. The tube is then removed from the wet sand and the moist sand plug is removed from the tube. The lower end of the tube is then reinserted into the cavity formed by removal of the sand plug, the lower end of the umbrella support pole is inserted into the upper end of the tube and then clamped thereto. Finally, the excavated area is filled in with dry sand U.S. Pat. No. 6,032,880 issued to Verrills, et al, discloses a ground spike for a sun umbrella. This beach umbrella support including a rigid hollow post with spiral flanges attached to the outside of the rigid hollow post.

U.S. Pat. No. 6,438,889 issued to Handy teaches a fishing rod support apparatus. This apparatus is basically a tripod stand and does not teach the use of a helical anchor screw, nor is it a motorized, automatic securement device.

U.S. Pat. No. 5,084,995 issued to Beaudoin discloses a fishing jigging apparatus. This device uses a weighted support platform with an articulating arm to secure the fishing pole.

U.S. Pat. No. 5,106,384 issued to Johnson teaches a pistol grip fishing pole. The pistol grip fishing pole stand includes a frame means that is designed to be inserted into the ground and provide support for the pistol grip fishing pole stand. The stand also includes a receptacle that is adapted to receive and engage the pistol grip shaped handle of a fishing pole.

Although there are ground stands in prior art, none of the foregoing patents combine, a helical anchor screw, a DC motor for automatic securement, and the ability to attach a variety of devices to the stand, such as an umbrella or a fishing pole.

SUMMARY OF INVENTION

This unique and novel invention, inspired by personal experience at a local beach, addresses the issue discussed above. It is intended for use in outdoor settings where it is necessary to firmly and securely place an umbrella, or other device such as a fishing pole in any malleable surface such as sand, grass or dirt.

The basic design of this device is very simple and its very simplicity makes it highly mobile and useful. The device, in general, is comprised of a main tube made of some flexible yet strong material such as PVC or injected molded plastic, a large auger anchor screw, a carrying handle, a three-function power switch, an extend/retract lock button and extend/retract lock ports, a securing nut for holding the objects, a safety nose, a power switch protector cover, and an inside assembly. The inside assembly comprises a power drive, a gear reduction box, a power drive coupler, and a power drive stabilizer and positioning nose cone. The power drive can be further broken down and comprises a rechargeable battery, a DC electric motor, and the three-function power switch. A user of this device would simply place the pipe vertically against the sand or other malleable surface with the helical anchor screw side down. The user would then apply positive downward pressure and engage the button, which in turn engages the anchor screw motor to screw the helical anchor screw into the surface. The user then attaches the umbrella, or other device, to the topmost portion of the main tube and secures the umbrella, or other device, with the hand fastening screw.

A further object of the present invention is to provide a portable, extremely mobile universal automatic multi-purpose ground stand that may be quickly and easily secured into a malleable surface by any person lacking the motor skills and/or motor strength to secure a traditional umbrella stand.

Still another object of this invention is to provide a universal automatic multi-purpose ground stand unit that comprises relatively simple materials, is relatively lightweight and durable, and is relatively simple to manufacture.

Yet another object of this invention is to provide a universal automatic multi-purpose ground stand for the securement of other devices such as a surf fishing pole.

Other objects, features and advantages of the present invention will become readily apparent from the following description of the invention and its preferred embodiment when considered with the attached drawings and the Claims.

DESCRIPTION OF THE INVENTION

Figure 1:
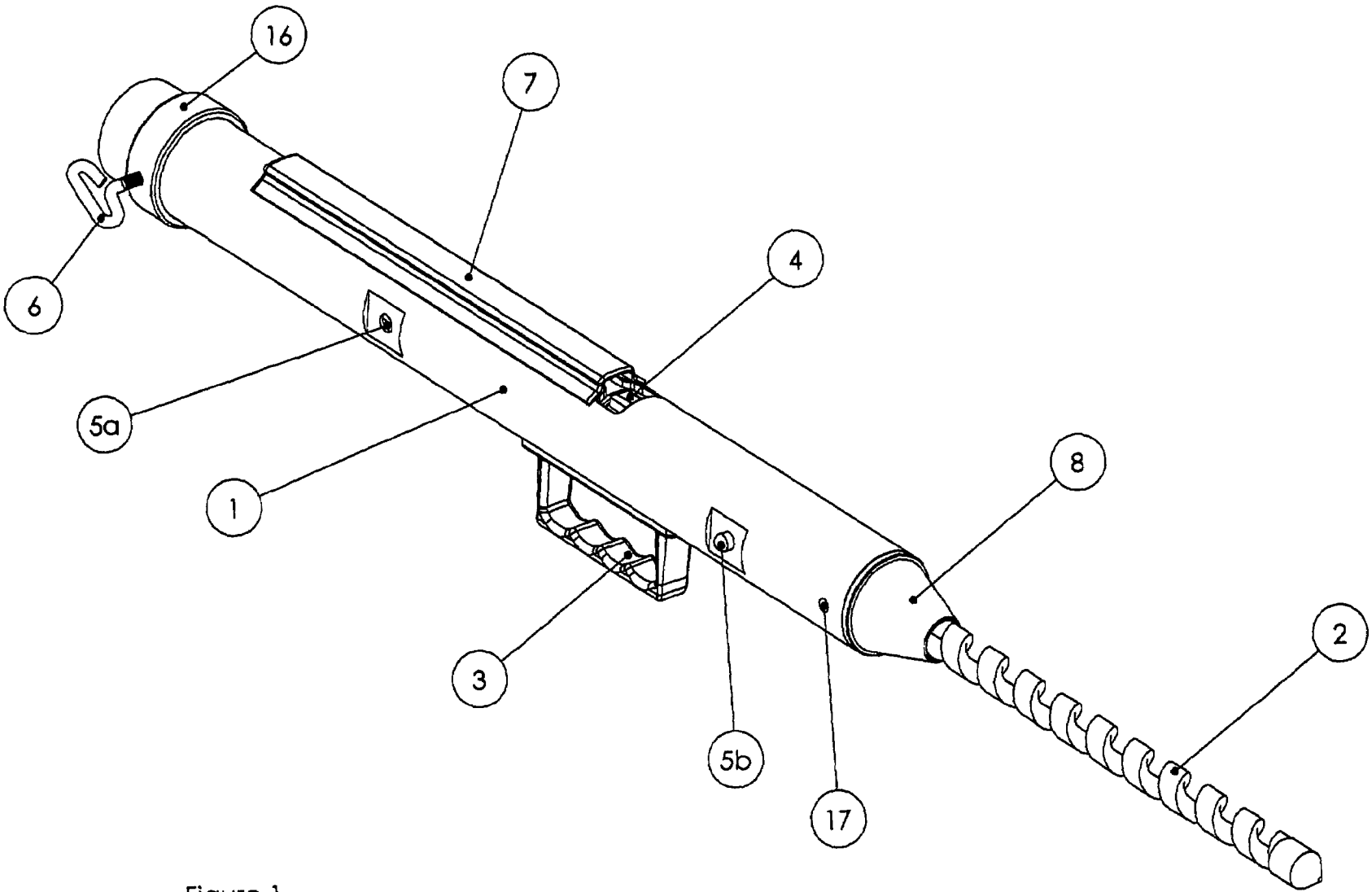
FIG. 1 depicts the outside, observable surface of the device in its entirety, in a three dimensional, isometric view.

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

Figure 2:
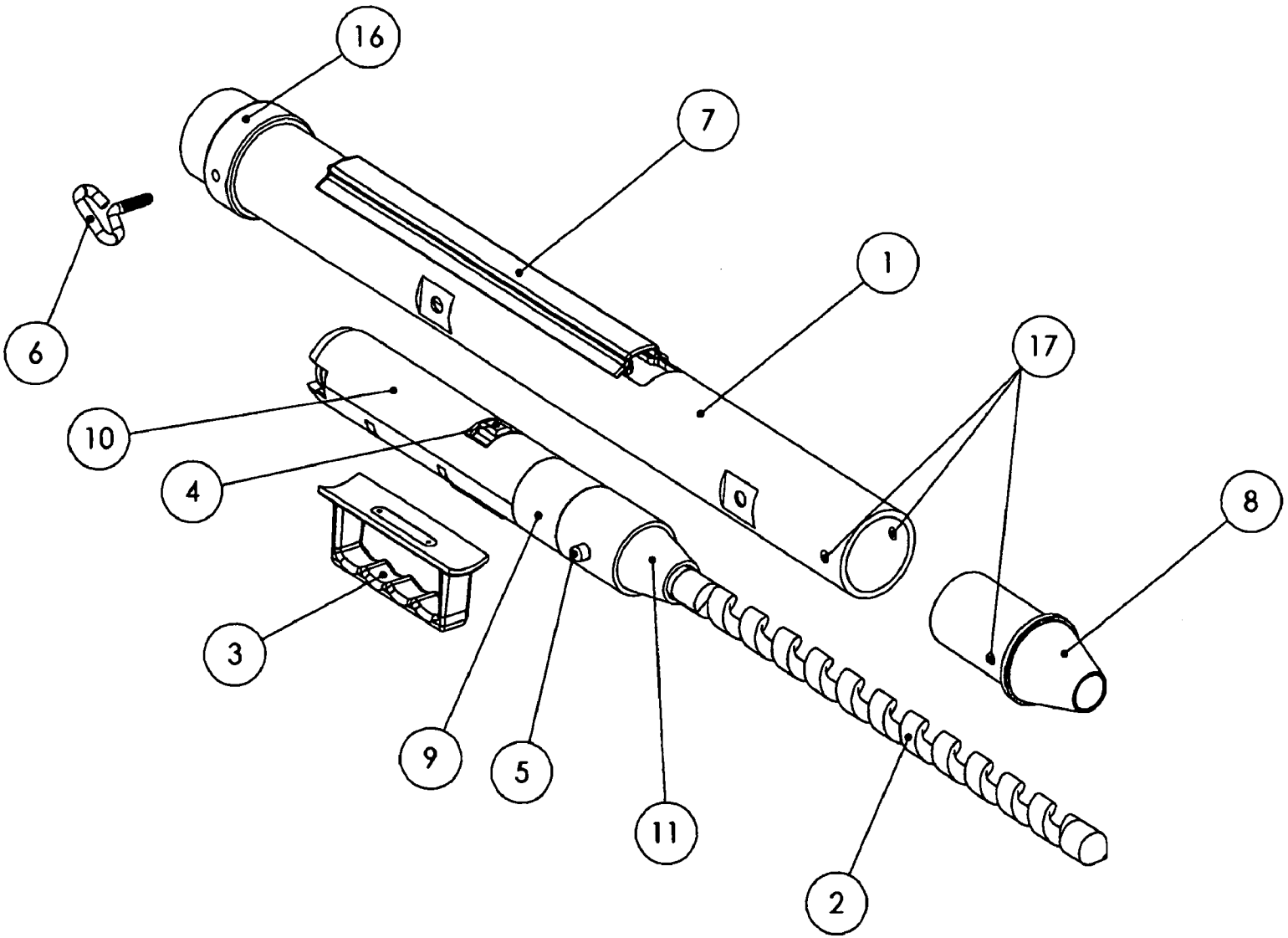
FIG. 2 depicts an exploded view of the device. This figure explicitly shows the securing nut, the safety nose, the carrying handle and exposes the inside assembly.

FIGS. 1-6 illustrate an automatic, universal, multi-purpose ground stand. The basic components of this design are the main tube 1 as shown in FIG. 1 and FIG. 2, the helical anchor screw 2, as shown in FIGS. 1-5, and the power drive 10 as shown in FIG. 2 and in more detail in FIG. 3. Each major component will be discussed in turn.

Figure 4:
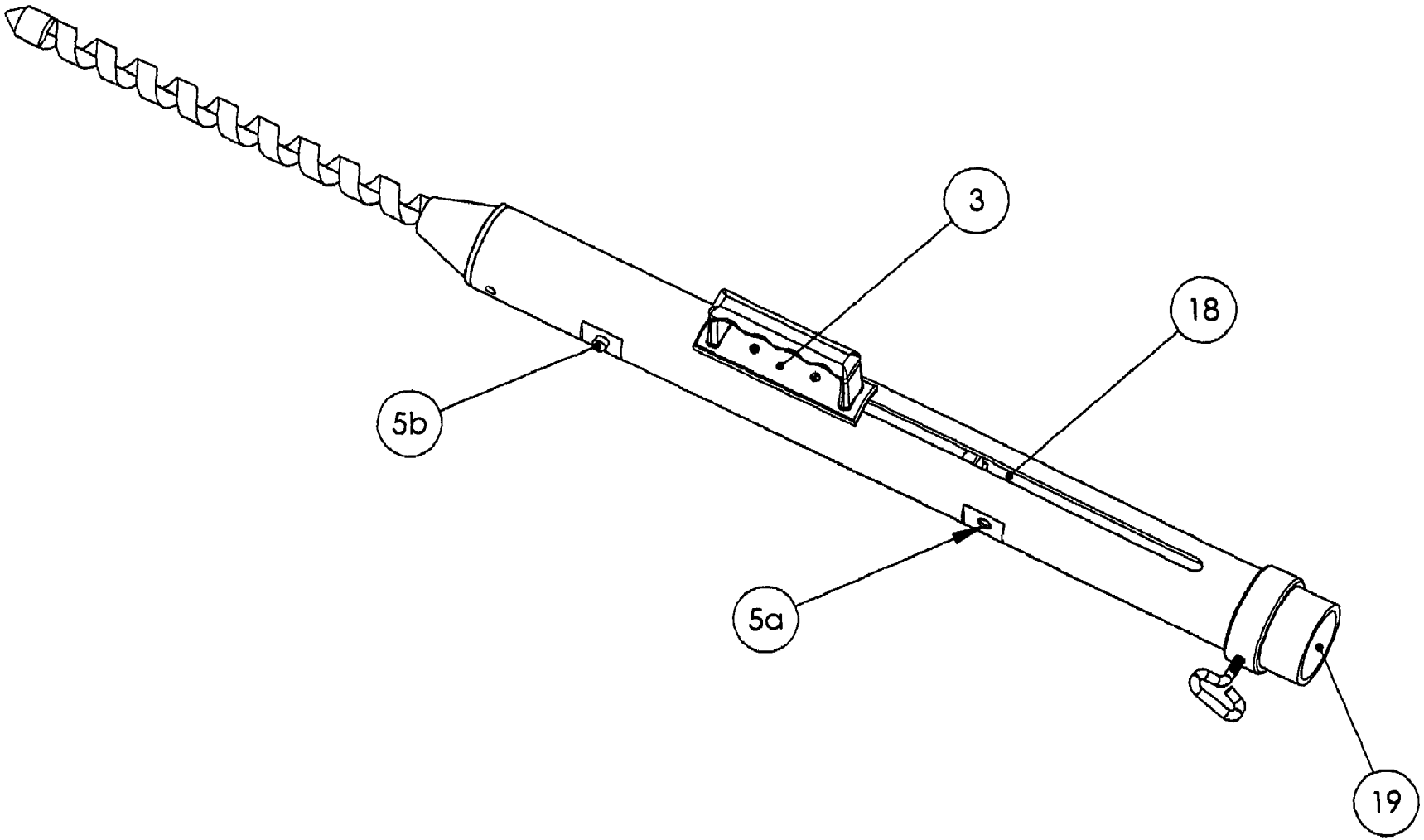
FIG. 4 depicts the obverse side of FIG. 1. It shows the outside observable surface of the device in its entirety, in a three-dimensional isometric view. It differs from FIG. 1 in that is depicts the carrying handle channel and the open end of the main tube in which a user would secure a device such as an umbrella or fishing pole.

The main tube 1, as shown in FIG. 1, FIG. 2, FIG. 4 and FIG. 6, is the backbone of the entire device. It is a rounded tube made from any rigid and durable material such as standard PVC piping. It can be designed and manufactured in a variety of colors. Attached to the main tube 1 are the reinforcement ring 16 and the securing nut 6, as shown in FIG. 1 and FIG. 2. The reinforcement ring 16 lends support to the main tube at the point where a user will insert a device into the holding tube 19 as shown in FIG. 4. The securing nut 6, allows the user to secure any applicable object into the holding tube 19. In this specification the securing nut 6 is defined as follows: a thumbscrew like device or a metal rod or pin for fastening objects together.

There is an enclosed power switch protector cover 7, as shown in FIG. 1 and FIG. 2. The three-function power switch 4 is exposed at the terminus of the power switch protector cover 7 when the inside assembly is in the down position, and prevents the user from retracting the helical anchor screw 2, unless the three-function power switch is in the neutral position. Finally, FIG. 1 and FIG. 2 shows a tapered safety nose 8 that attaches and seals the bottom of the main tube 1. The tapered shape of the safety nose 8 prevents a user from catching his or her finger in the screw when the motor is engaged and the helical screw 2 is being retracted. The bottom of the main tube also has a safety nose setscrew 17, as shown in FIG. 1 that allows the safety nose to be removed, and enables the user to remove the entire inside assembly for maintenance purposes.

Figure 6:
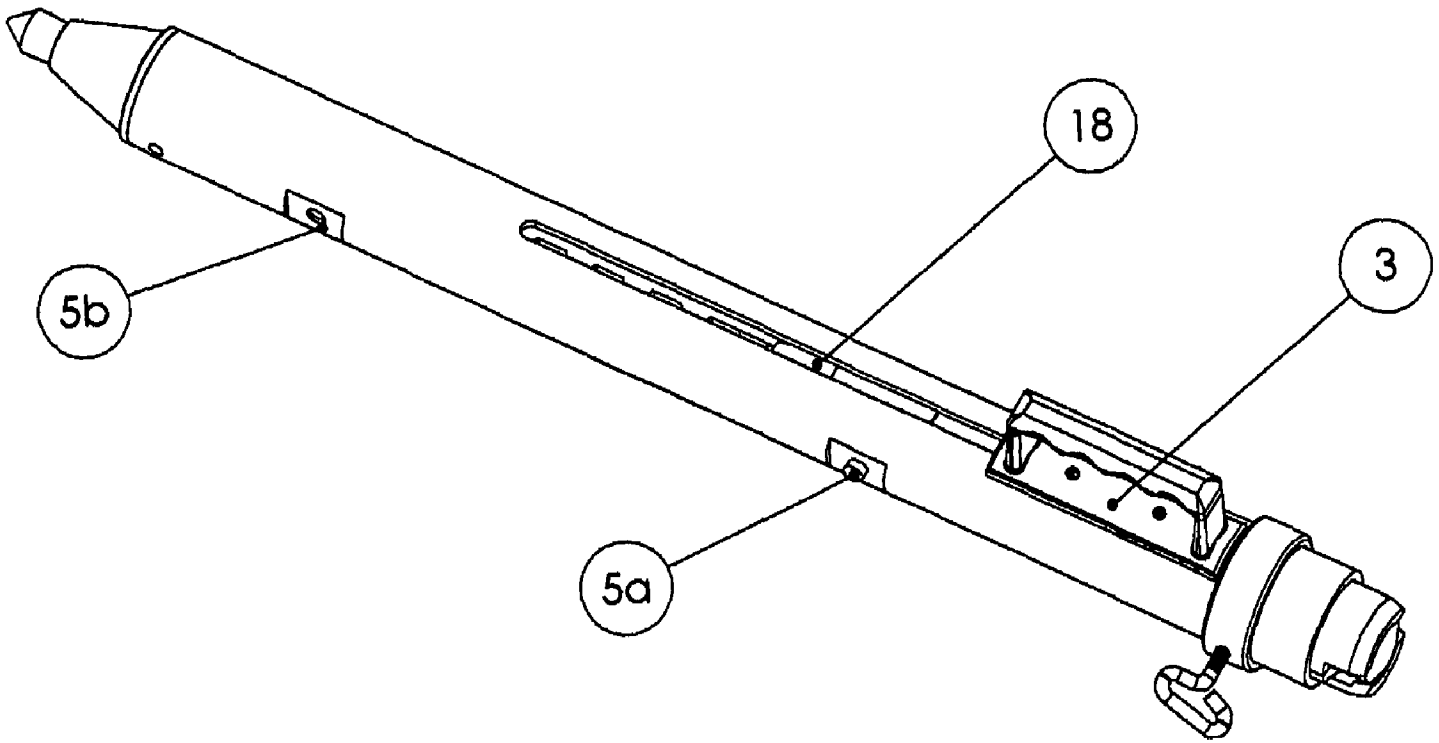
FIG. 6 depicts the device with the helical anchor screw fully retracted.

FIG. 4 and FIG. 6 depict the carrying handle channel 18. The carrying handle 3 is situated in the carrying handle channel 18 and is used to slide the power drive 10 up and down the main tube. The power drive 10, as shown in FIG. 2 and FIG. 3 and discussed in more detail below, can be retracted and extended inside the main tube 1 by use of the extend/retract lock button 5 and lock button spring 12, as shown in FIG. 2 and FIG. 3; the corresponding extend and retract lock ports 5A and 5B, as shown in FIG. 1, FIG. 4 and FIG. 6; and by use of the carrying handle 3 as shown in FIG. 1, FIG. 4 and FIG. 6.

Figure 3:
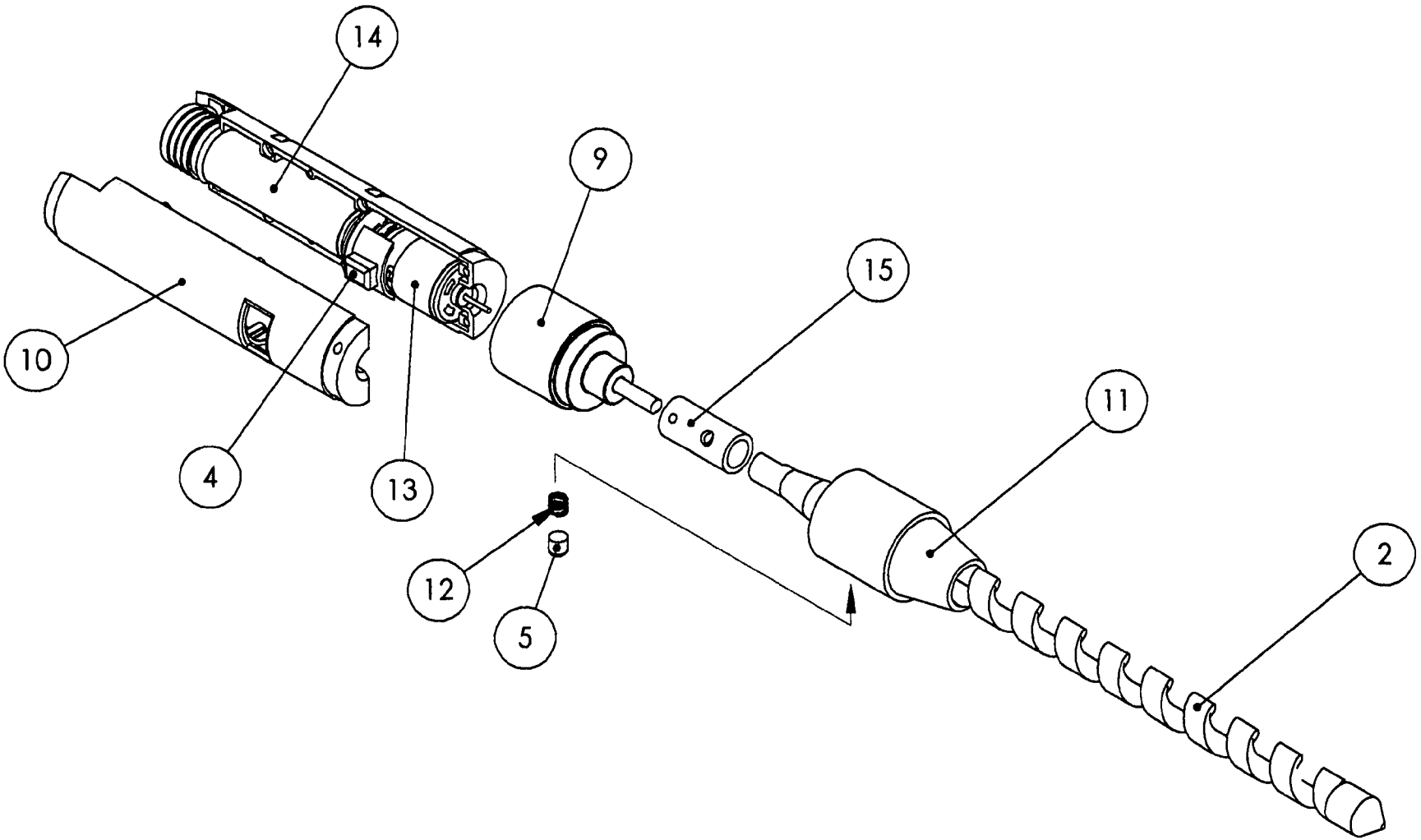
FIG. 3 depicts and exploded view of the inside assembly. This view explicitly shows the rechargeable battery, the three-function power switch, the DC electric motor, the gear reduction box, the power drive coupler and the power drive stabilizer and positioning nose.

The helical auger anchor screw 2 is shown in FIGS. 1-3. The anchor screw 2 is another integral part of this apparatus. When extended the helical anchor screw 2 is the portion of the stand that is secured into the ground or other malleable surface. The helical anchor screw 2 attaches to the power drive 10 by being placed inside of the power drive stabilizer and positioning nose 11 and is coupled to the power drive 10 with the power drive coupler 15. The power drive stabilizer and positioning nose 11 is then slid into place and secured against the gear reduction box 9. The helical anchor screw, as depicted in FIGS. 1-3, is a large auger type of bit. The outside portion of the thread is flat. The helical anchor screw 2 is long enough to securely affix the umbrellas stand in the ground. In the current implementation the helical anchor screw 2 is nine inches long. Furthermore, the shaft of the helical anchor screw 2 is square at the top to prevent a user from accidentally catching anything in the helical anchor screw where it meets the main tube.

The inside assembly is depicted in FIG. 2, and in more detail in FIG. 3. The inside assembly comprises the power drive 10, the gear reduction box 9, and the power drive stabilizer and positioning nose 11. The power drive 10 can be further broken down and comprises the rechargeable battery 14, the three-function power switch 4, and the DC electric motor 13. The battery 14 is a standard rechargeable battery readily available at any retail store. The current implementation uses a 3.6-volt battery. The capacity of the anchor screw motor determines the exact voltage requirements of the battery. The motor, in this implementation, is a DC electric motor.

Figure 5:
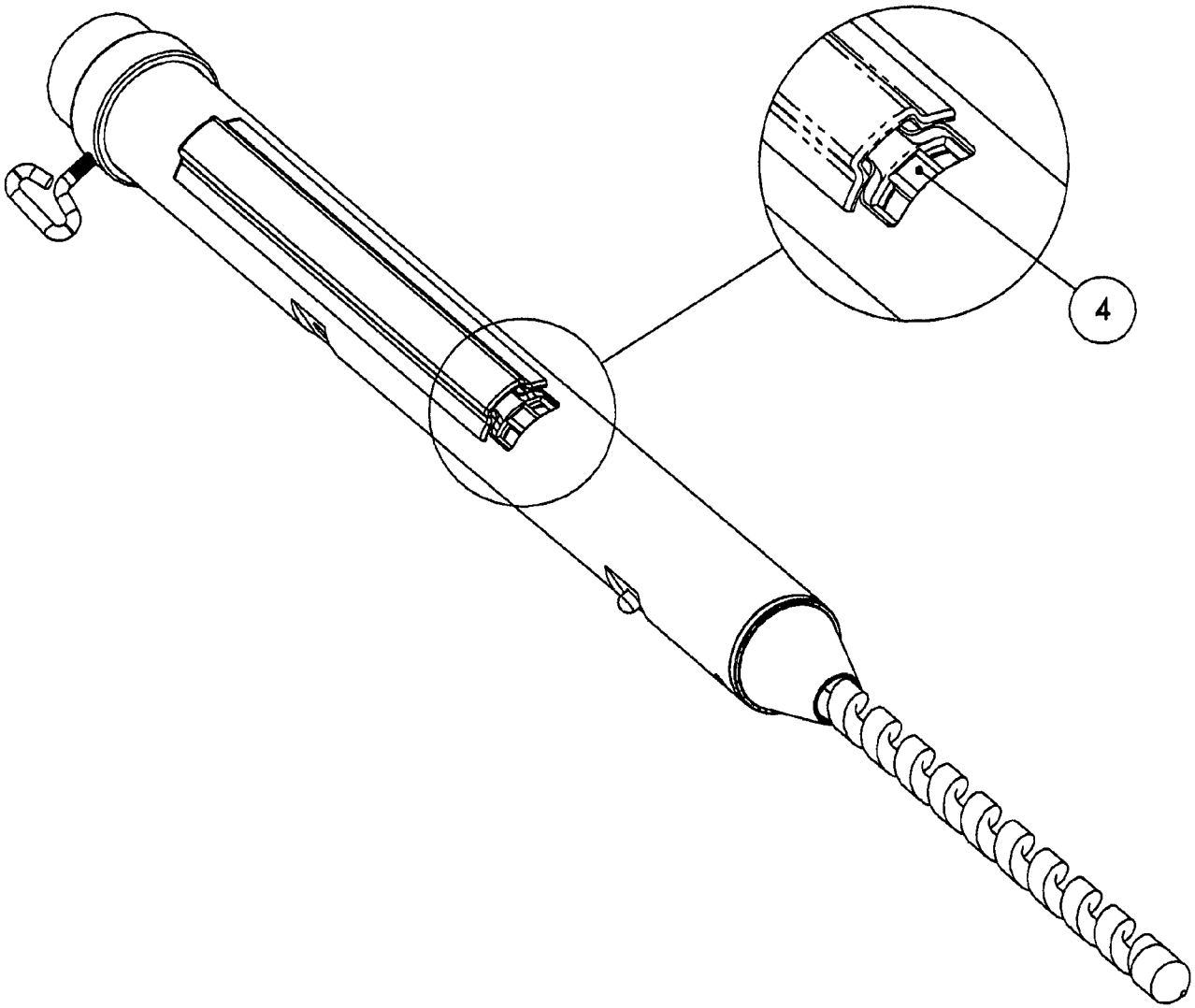
FIG. 5 depicts a close up view of the terminus of the power switch protector cover channel. The purpose of this figure is to clearly depict how the three-function power switch can only be retracted when it is in the neutral position.

When the inside assembly is in the down position, the three-function power switch 4 is exposed for use at the terminus of the power switch protector cover channel 7 as shown in FIG. 1 and shown in more detail in FIG. 5. The three-function power switch 4 has three positions. The positions are neutral, forward and reverse. "Neutral" is the default position for safety reasons. The inside assembly can be retracted, as shown in FIG. 6, only when the three-function power switch 4 is in neutral. If the three-function power switch 4 is in any other position the three-function power switch is in one of the horizontal ends of the "T", and thus not aligned with the shaft of the power switch protector cover channel 7. In the "forward" position, the user can depress the switch. Depressing the three-function power switch 4 engages the DC electric motor 13, which in turn rotates the helical anchor screw 2 clockwise. In the "reverse" position, the user can also depress the three-function power switch 4. Depressing the three-function power switch 4 engages the DC electric motor 13, which in turn rotates the helical anchor screw 2 counter-clockwise.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, description contained in this specification is to be considered exemplary, rather than limiting, and the true scope of the invention is only limited by the following claims and any equivalents thereof.

What is claimed is:

1. An automatic anchoring device for the securement of objects into sand, grass, or other malleable surfaces comprising:

a. a main tube;
b. an anchor screw;
c. an inside assembly comprised of components that fit together to form one mechanism inside the main tube;
d. a reinforcement ring and a securing nut proximately placed near the top of the main tube;
e. the main tube further comprises a carrying handle, a carrying handle channel, an extract and retract lock button and corresponding extract and retract ports;
f. whereby said inside assembly comprises a power drive, a gear reduction box, and a power drive stabilizer and positioning cone;
g. whereby said power drive comprises a rechargeable battery, a DC electric motor and a three-function power switch;
h. whereby said anchor screw affixes to said power drive;
i. whereby depressing said three-function power switch engages said DC electric motor, which in turn rotates said anchor screw into and out of said surface; and
j. whereby said reinforcement ring and securing nut can secure an umbrella of an appropriate diameter into said anchoring device.

2. The automatic anchoring device as claimed in claim 1 wherein a three-function power switch channel acts as a safety device whereby said three-function power switch can only be in the forward or reverse position when the anchor screw is fully extended.

3. The automatic anchoring device as claimed in claim 2 wherein a safety nose is affixed to the end of the main tube to help prevent the accidental intake of any material between the main tube and the anchor screw.

4. The automatic anchoring device as claimed in claim 3 wherein said anchor screw is comprised of a plurality of helical tapers.

5. The automatic anchoring device as claimed in claim 4 wherein an umbrella is secured with a securing nut to the topmost portion of the main tube.

6. A device as claimed in claim 5, wherein said inside assembly can be removed for maintenance purposes by adjusting a safety nose setscrew.

7. An automatic anchoring device for the securement of objects into sand, grass, or other malleable surfaces comprising:

a. a main tube comprising a carrying handle, a carrying handle channel, an-extract and retract lock button and corresponding extract and retract ports;
b. an anchor screw comprised of a plurality of helical tapers;
c. an inside assembly comprised of components that fit together to form one mechanism inside the main tube;
d. a reinforcement ring and a securing nut proximately placed near the top of the main tube;
e. whereby said inside assembly comprises a power drive, a gear reduction box, and a power drive stabilizer and positioning cone;
f. whereby said power drive comprises a rechargeable battery, a DC electric motor and a three-function power switch;
g. whereby said anchor screw affixes to said power drive;
h. whereby depressing said three-function power switch engages said DC electric motor, which in turn rotates said anchor screw into and out of said surface;
i. whereby said reinforcement ring and securing nut secures any device of an appropriate diameter into said anchoring device;
j. a three-function power switch channel acts as a safety device whereby said three-function power switch can only be in the forward or reverse position when the anchor screw is fully extended;
k. a safety nose is affixed to the end of the main tube to help prevent the accidental intake of any material between the main tube and the anchor screw; and
l. an umbrella can be secured with a securing nut to the topmost portion of the main tube.

8. The automatic anchoring device as claimed in claim 7 wherein said inside assembly can be removed for maintenance purposes by adjusting a safety nose setscrew.

9. The automatic anchoring device as claimed in claim 7 wherein a fishing rod can be secured with a securing nut to the topmost portion of the main tube instead of the umbrella.

10. An automatic anchoring device for the securement of objects into sand, grass, or other malleable surfaces comprising:

a. a main tube;
b. an anchor screw;
c. an inside assembly comprised of components that fit together to form one mechanism inside the main tube;
d. a reinforcement ring and a securing nut proximately placed near the top of the main tube;
e. the main tube further comprises a carrying handle, a carrying handle channel, an extract and retract lock button and corresponding extract and retract ports;
f. whereby said inside assembly comprises a power drive, a gear reduction box, and a power drive stabilizer and positioning cone;
g. whereby said power drive comprises a rechargeable battery, a DC electric motor and a three-function power switch;
h. whereby said anchor screw affixes to said power drive;
i. whereby depressing said three-function power switch engages said DC electric motor, which in turn rotates said anchor screw into and out of said surface; and
j. whereby said reinforcement ring and securing nut can secure a fishing rod of an appropriate diameter into said anchoring device.

* * * * *